US006879302B2

(12) United States Patent
Peng

(10) Patent No.: US 6,879,302 B2
(45) Date of Patent: Apr. 12, 2005

(54) ANTENNA CONNECTION MODULE

(75) Inventor: Po-Hsuan Peng, Taipei Hsien (TW)

(73) Assignee: Mitac Technology Corp., Hsin-Chu Hsien (TW)

( * ) Notice: Subject to any disclaimer, the term of this patent is extended or adjusted under 35 U.S.C. 154(b) by 53 days.

(21) Appl. No.: 10/644,763

(22) Filed: Aug. 21, 2003

(65) Prior Publication Data

US 2005/0040998 A1 Feb. 24, 2005

(51) Int. Cl.[7] ..... H01Q 1/50
(52) U.S. Cl. ..... 343/906; 343/702
(58) Field of Search ..... 343/702, 906, 343/900

(56) References Cited

U.S. PATENT DOCUMENTS 2,966,811 A * 1/1961 Sundt ..... 475/178
5,022,861 A * 6/1991 Aoto ..... 439/13
5,576,720 A * 11/1996 Gorenz et al. ..... 343/702
5,714,963 A * 2/1998 Cox ..... 343/786
5,821,907 A * 10/1998 Zhu et al. ..... 343/906
5,828,341 A * 10/1998 Delamater ..... 343/702
6,133,884 A * 10/2000 Talvitie et al. ..... 343/702
6,304,233 B1 * 10/2001 Chan ..... 343/906

* cited by examiner

*Primary Examiner*—Shih-Chao Chen
(74) *Attorney, Agent, or Firm*—Harness, Dickey & Pierce, PLC

(57) ABSTRACT

An antenna connection module adopted for use on electronic devices has an anchoring and rotary structure to provide discrete and staged positioning. It includes a rotary tray, which has a plurality of anchor troughs formed thereon, and an antenna dock coupled with the rotary tray to turn relative to the rotary tray without separating. The antenna dock houses rolling balls that engage with the anchor troughs to provide discrete and staged clicking and anchoring effects.

9 Claims, 4 Drawing Sheets

ANTENNA CONNECTION MODULE

FIELD OF THE INVENTION

The invention relates to an antenna connection module adopted for use in radio transmission for electronic devices and particularly to an antenna connection module that can be turned in discrete stages and that is waterproof.

BACKGROUND OF THE INVENTION

With the abundance of advanced technology these days, the capability of surfing the Internet and transmitting and receiving data wirelessly has become fundamental and a mandatory requirement for electronic devices. Through wireless transmission, not only can users access the Internet to receive and transmit the most up to date information, they can also obtain cutting edge technologies whenever needed. General portable electronic devices such as notebook computers, wireless Internet machines or bridge devices all use antennae to perform transmission.

Conventional antennae are often pivotally connected or connected through an anchor dock to the electronic devices so that the antennae may be swiveled or turned relative to the electronic devices to alter receiving positions, angles or polarization directions. Thereby users can adjust the antennae to the optimal position and angle relative to the emission location during operation to achieve the optimum results.

However, most antennae are not designed to be waterproof and impact-resistant. Namely, on the juncture between the antenna and the electronic device, water can seep in and damage the electronic device. On the other hand, while the antenna is quite strong and not easily damaged, the connection spot is quite fragile. Incidental dropping or impact could cause the antenna to be dislodged from the electronic device. Moreover, the antennae are mostly designed in a rotary manner, and are mostly fastened by screws. Turning the antenna in one direction continuously could cause the antenna to become loose. The conventional connection structure also does not have a positioning function. When in use, there is no discrete and staged positioning function, and electronic communication is not as reliable as desired.

SUMMARY OF THE INVENTION

In view of the aforesaid disadvantages, the object of the invention is to provide an antenna connection module that has a strong structure and is waterproof and impact-resistant, and also provides a rotational positioning function.

The antenna connection module according to the invention includes a rotary tray, an antenna dock and at least one anchor bump. The rotary tray has one end fastened to an electronic device and another end with a plurality of anchor troughs formed thereon. The antenna dock is coupled on one end of the rotary tray corresponding to where the anchor troughs are located and is rotatable relative to the rotary tray without separating. The anchor bump is located in the antenna dock mating to the anchor troughs of the rotary tray and is engagable with one anchor trough. Thus the antenna dock may be turned relative to the rotary tray to provide different positioning directions.

In another embodiment of the invention, the antenna dock is constructed so as to be rigid, and formed in an integrated manner to increase the strength of the connection module and achieve impact-resistance. A rubber ring is coupled on the connection juncture to provide a waterproof function. The rotary tray and the antenna dock may be coupled by means of a pin, which runs through an anchor hole on the antenna dock to latch in a latch groove of the rotary tray and prevent the antenna from escaping from the rotary tray, enabling the antenna to turn about the rotary tray.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
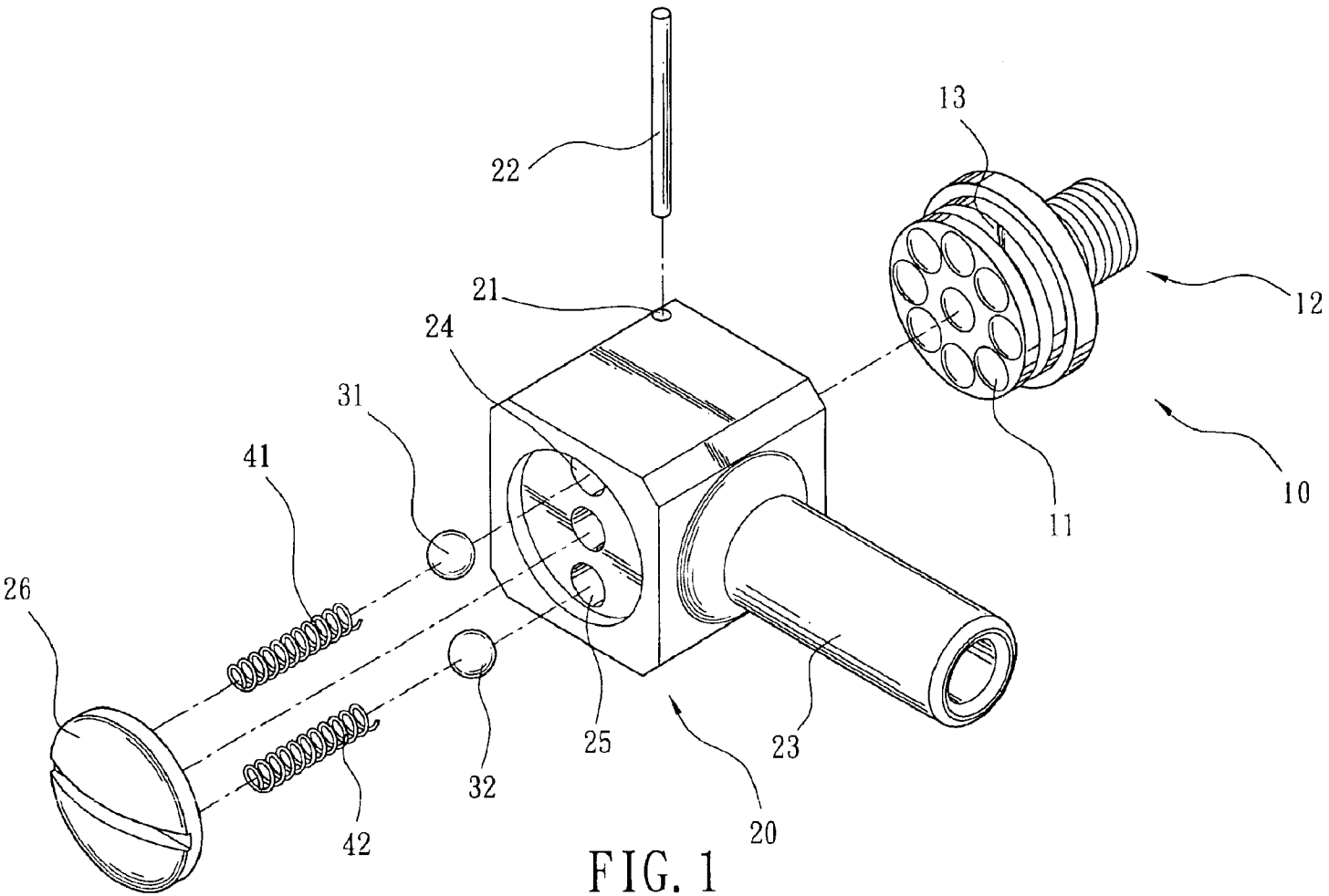
FIG. 1 is an exploded view of the invention.
Figure 2:
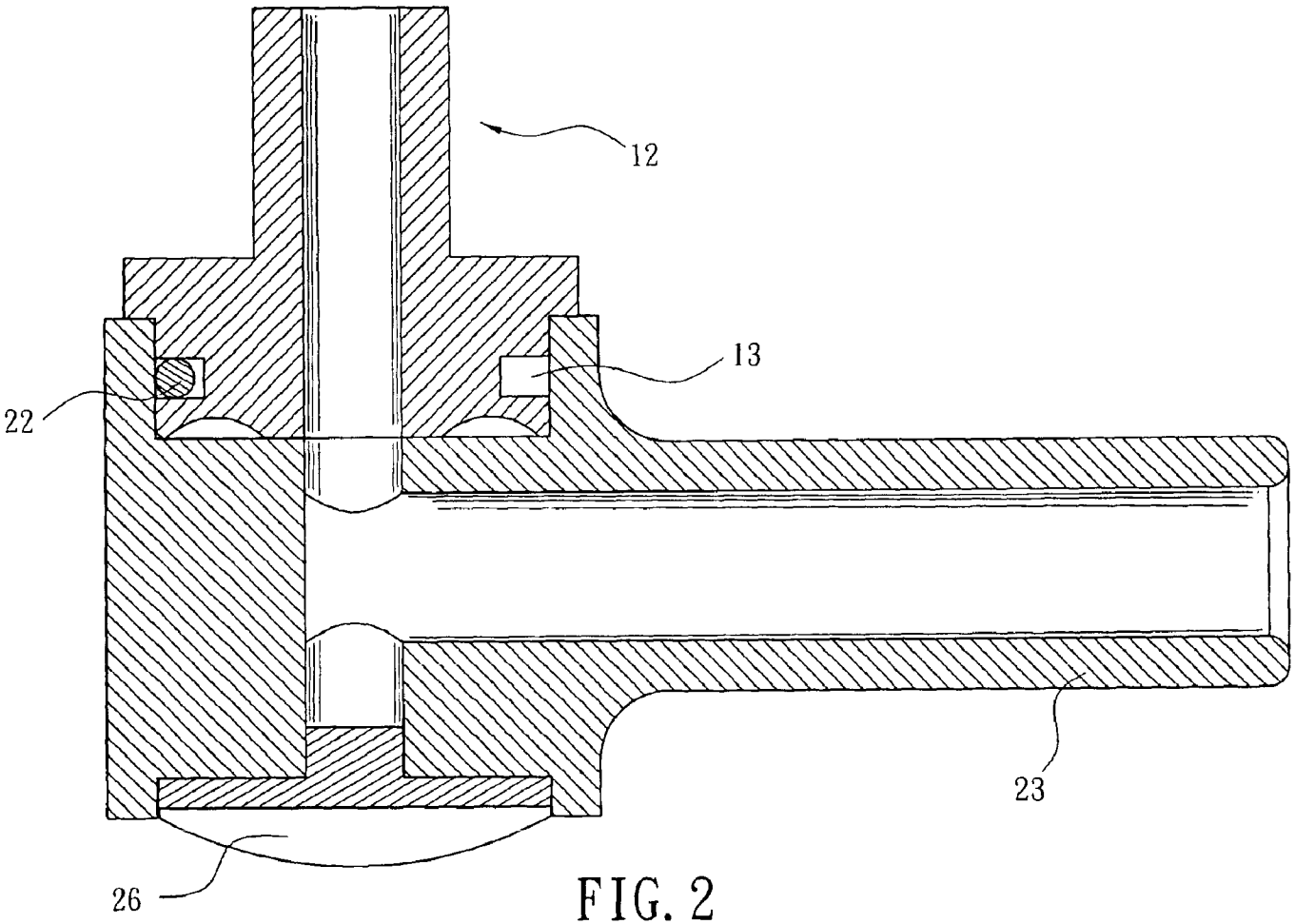
FIG. 2 is a sectional view of the invention.

Referring to FIG. 1, the antenna connection module of the invention includes a rotary tray 10, an antenna dock 20 and anchor bumps. The anchor bumps may be formed in various fashions. The following shows two rolling balls 31 and 32 as an example. The rotary tray 12 has a connection end 12 on one side and a substantially flat side on the other end with a plurality of anchor troughs 11 formed thereon. The anchor trough 11 may be formed in the shape of a semispherical concave cavity. The rotary tray further has an annular groove 13 on the middle section. The antenna dock 20 is hollow and has a bottom end to couple with the rotary tray 10, a top end formed with two ball troughs 24 and 25, an anchor strut 23 on one side, and an anchor hole 21 on the other side. The bottom of the antenna dock 20 is coupled to the rotary tray 10 on one side where the anchor troughs 11 are located. Then a pin 22 is used to run through the anchor hole 21 into the antenna dock 20 to wedge in the latch groove 13 of the rotary tray 10 so that the antenna dock 20 may be swiveled and turned relative to the rotary tray 10 without separating from the rotary tray 10 (also referring to FIG. 2).

The rolling balls 31 and 32 are housed in the ball troughs 24 and 25 of the antenna dock 20, and are pushed respectively by springs 41 and 42 on the rear side. A cap 26 is provided to encase the springs 41, 42 and rolling balls 31 32 in the antenna dock 20, and keep the rolling balls 31 and 32 in the anchor troughs 11 of the rotary tray 10 to form an anchoring effect (referring to FIG. 2). Through the design of the rolling balls 31 and 32, when the antenna dock 20 is turned, the rolling balls 31 and 32 may be held and anchored in two opposing anchor troughs 11 to generate an anchoring effect. Thus it is more reliable and a staged clicking is produced when in use.

Moreover, the antenna dock 20 is formed in an integrated manner, and may be made of stainless steel. The rotary tray 10 may be made of aluminum alloy to enhance the strength of the connection module and achieve impact-resistance. In addition, referring to FIG. 4, when coupled to an electronic device 70, a rubber ring 51 may be used with a waterproof adhesive to achieve a waterproof effect on the juncture between the antenna and the electronic device 70.

Figure 3:
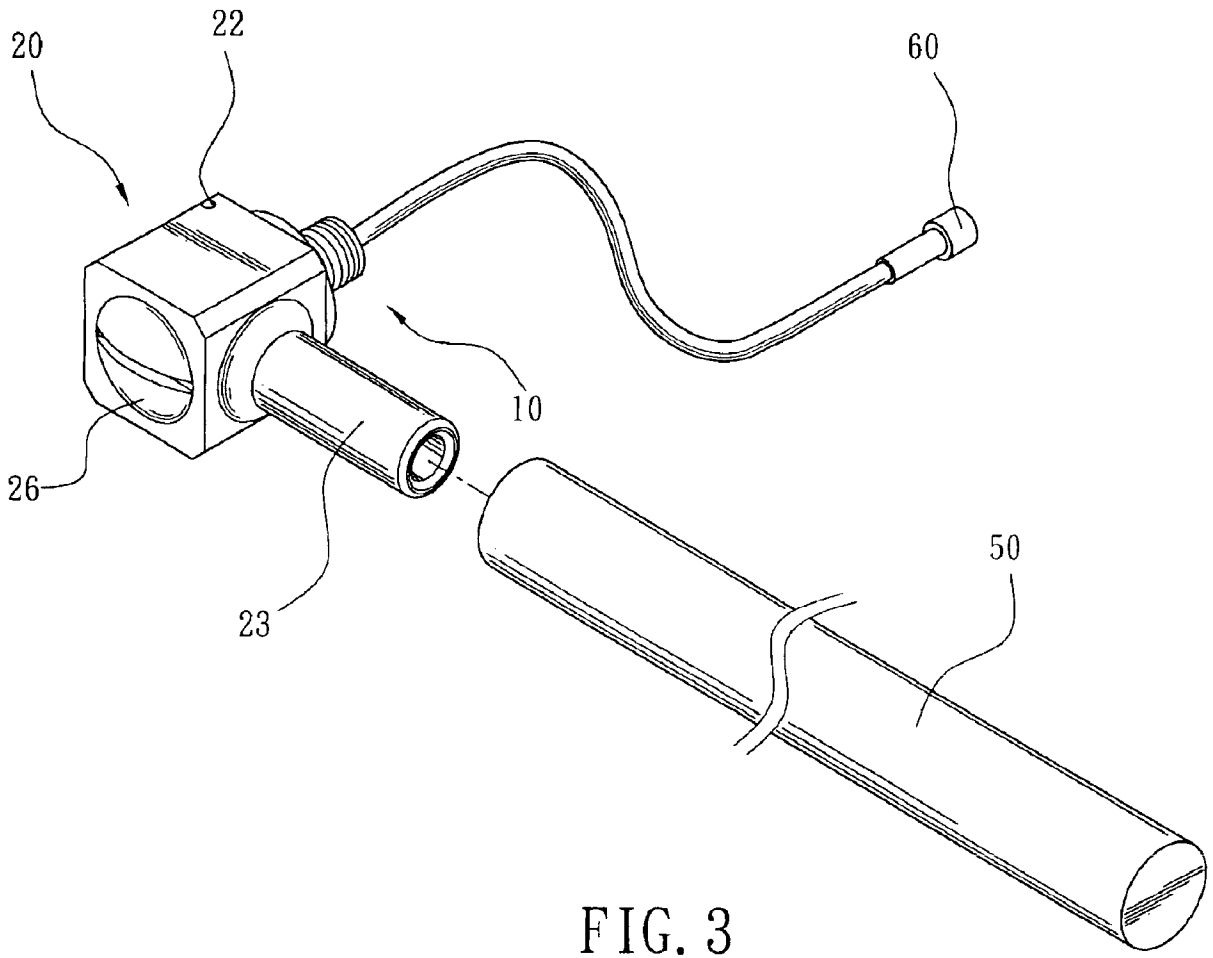
FIG. 3 is a schematic view showing the invention engaging with a coupling sleeve.
Figure 4:
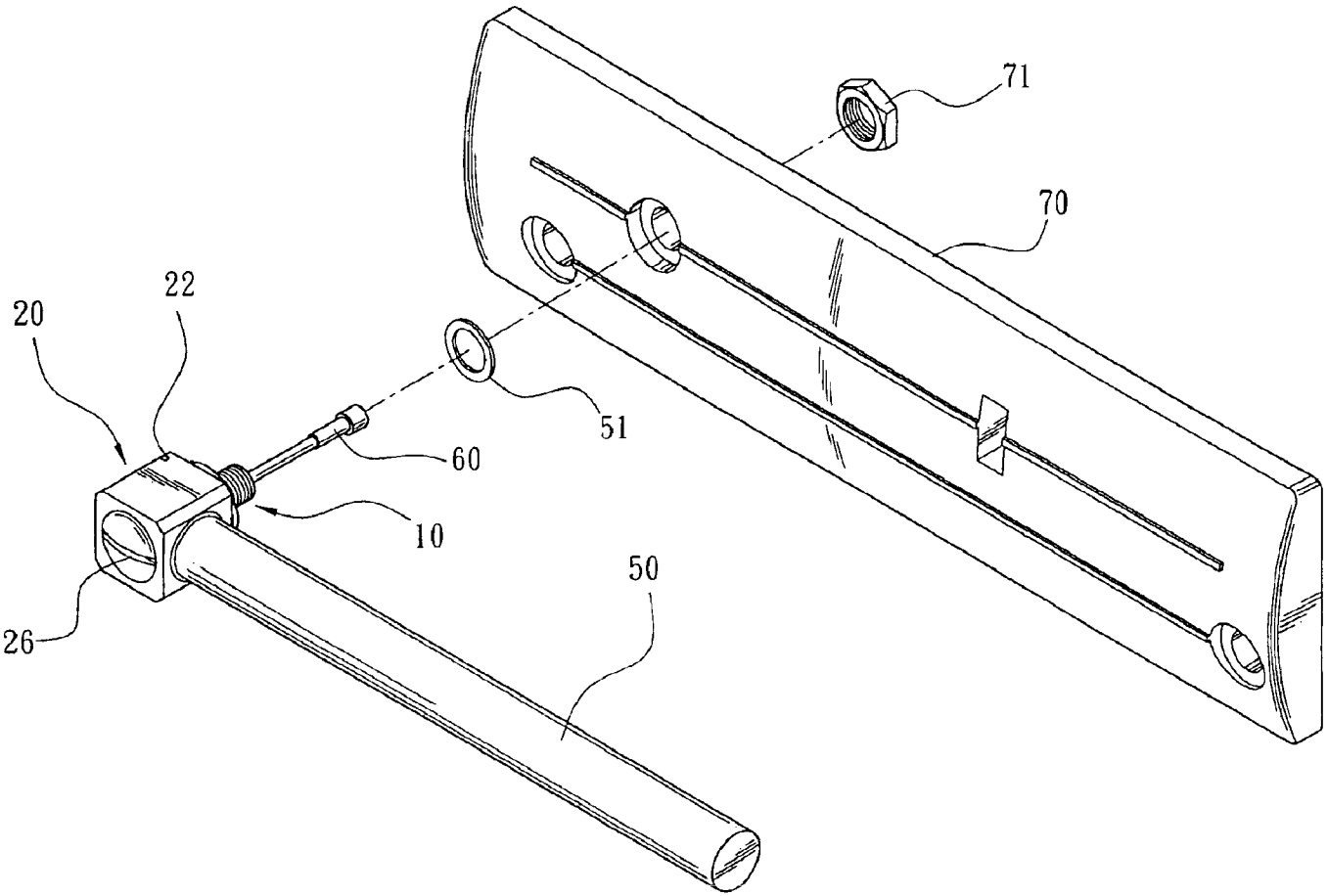
FIG. 4 is a schematic view showing the invention coupling to an electronic device.

Referring to FIG. 3, the anchor strut 23 on one side of the antenna dock 20 is coupled with a sleeve 50. Both the sleeve 50 and the anchor strut 23 are hollow and communicate with the rotary tray 10 to enable an antenna 60 to run through the connection end 12, passing the rotary tray 10, the antenna dock 20 and the anchor strut 23 and into the sleeve 50 to obtain effective protection. Then the antenna module may be fastened to the electronic device 70 with a nut 71, as shown in FIG. 4. When the antenna is turned, the antenna dock 20 turns relative to the rotary tray 10. The rotary tray 10 is fixedly fastened to the electronic device 71. Thus, even if the antenna is swiveled or turned in one direction continuously, it does not loosen and is held steadily.

In short, the antenna connection module of the invention has a pin running through an anchor hole on an antenna dock to engage with a latch groove of a rotary tray to keep the antenna from separating from the rotary tray. In addition, the antenna may be turned relative to the rotary tray. Rolling balls are housed in an antenna dock to mate with the anchor troughs on the rotary tray such that the rolling balls may engage with one of the anchor troughs. Thus when the antenna dock is turned relative to the rotary tray, a desired positioning direction may be provided and a staged click may be obtained. Furthermore, the antenna dock may be formed in an integrated manner and constructed with rigidity to enhance the strength of the antenna connection module and improve the impact-resistant capability. A rubber ring may be mounted on the connection juncture to achieve a waterproof effect.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An antenna connection module for anchoring on an electronic device, comprising:

a rotary tray having one end fastened to the electronic device and other end having a plurality of anchor troughs formed thereon;

an antenna dock coupling with the rotary tray and rotatable relative to the rotary tray without escaping; and an anchor bump located in the antenna dock corresponding to the anchor troughs such that when the antenna dock is turned relative to the rotary tray the anchor bump is engaged with one of the anchor troughs to generate an anchoring effect.

2. The antenna connection module of claim 1, wherein the anchor bump is a rolling ball housed in the antenna dock at a location corresponding to the anchor troughs.

3. The antenna connection module of claim 2 further having an elastic element located on a rear side of the rolling ball to keep the rolling ball in the anchor trough in normal conditions.

4. The antenna connection module of claim 3, wherein the elastic element is a spring.

5. The antenna connection module of claim 1, wherein the rotary tray has a latch groove formed in a middle section to constrain the antenna dock from escaping from the rotary tray when the anchor dock turns relatively to the rotary tray.

6. The antenna connection module of claim 5, wherein the antenna dock has an anchor hole to receive a pin to engage with the latch groove to prevent the antenna dock from escaping from the rotary tray when the anchor dock turns relatively to the rotary tray.

7. The antenna connection module of claim 1, wherein the antenna dock has one side extending to form an anchor strut to couple with a sleeve.

8. The antenna connection module of claim 7, wherein the anchor strut is hollow and communicates with the rotary tray to allow an antenna to run from the electronic device through the rotary tray and the antenna dock and the anchor strut into the sleeve.

9. The antenna connection module of claim 1 further having a rubber ring interposed between the rotary tray and the electronic device.

* * * * *